United States Patent [19]

Iannelli

[11] Patent Number: 4,482,509

[45] Date of Patent: Nov. 13, 1984

[54] CARBONATING APPARATUS

[75] Inventor: Frank M. Iannelli, Spartanburg, S.C.

[73] Assignee: Gerlach Industries, Inc., Spartanburg, S.C.

[21] Appl. No.: 472,001

[22] Filed: Mar. 4, 1983

[51] Int. Cl.[3] ..... B01F 3/04

[52] U.S. Cl. ..... 261/64 B; 99/323.1; 137/115; 222/129.1; 261/124; 261/DIG. 7

[58] Field of Search ..... 261/64 R, 64 B, 124, 261/DIG. 7; 99/323.1; 137/102, 115, 116, 116.3; 426/477; 141/70, 192; 222/129.1

[56] References Cited

U.S. PATENT DOCUMENTS

| | | | |
|---|---|---|---|
| 2,782,016 | 2/1957 | Iannelli | 261/DIG. 7 |
| 3,337,197 | 8/1967 | Iannelli | 261/DIG. 7 |
| 3,565,405 | 2/1971 | Black | 222/129.1 X |
| 3,578,214 | 5/1971 | Iannelli | 222/129.1 |
| 3,726,102 | 4/1973 | Parks | 261/DIG. 7 |
| 3,752,452 | 8/1973 | Iannelli | 261/124 X |
| 3,960,164 | 6/1976 | Kelley | 261/DIG. 7 |
| 4,132,241 | 1/1979 | Iannelli | 137/102 |
| 4,187,262 | 2/1980 | Fessler et al. | 426/477 X |
| 4,304,736 | 12/1981 | McMillin et al. | 99/323.1 X |

*Primary Examiner*—Richard L. Chiesa

*Attorney, Agent, or Firm*—Julian W. Dority

[57] ABSTRACT

A carbonator valve assembly (A) is disclosed which includes a water valve entrance subassembly (B), a gas regulator valve entrance subassembly (C), and a vent valve subassembly (D) formed in a valve head (12) sealingly fitted in a neck of a carbonator tank (10). Gas entrance regulator valve subassembly (C) includes a pressure regulator-delivery valve means (E) which delivers a restricted flow of pressurized gas to a gas dispensing chamber (80) via a passage (100) and restricted outlet port (102). An unrestricted path for the pressurized gas is established through the carbonator valve assembly (A) via a control valve chamber (56) passage (64), chamber (62), passage (70), chamber (72), passage (78), and dispensing chamber (80). Dispensing chamber (80) includes valve seat (84) through which both the restricted and unrestricted gas flows enter the carbonator tank. In the presence of an excessive pressure on diaphragm (98) of gas regulator valve means (E), a valve member (96) is caused to move against a spring (104) which determines the excess pressure level at, for example, 60 psi. Valve (96) moves until a valve tip (108) closes valve seat (84) closing off both restricted and unrestricted flows.

10 Claims, 6 Drawing Figures

CARBONATING APPARATUS

BACKGROUND OF THE INVENTION

The invention relates to carbonating apparatus wherein a liquid is carbonated and delivered to a mixing valve wherein the carbonated liquid and a syrup are mixed and dispensed as a carbonated beverage. In particular, the invention relates to a pressure regulated carbonating apparatus which includes a safety pressure regulating valve subassembly to insure that the carbonated liquid is not dispensed in an overpressurized form. Other improvements to carbonating apparatus are also disclosed and the subject of this invention.

Heretofore, it has been known to supply carbonating apparatus such as that disclosed in applicant's U.S. Pat. No. 3,752,452 wherein a liquid such as water is carbonated and delivered to a beverage mixing and dispensing valve. Pressurized carbonating gas is delivered through a restricted passage during a non-dispensing mode to maintain a pressurized head in the carbonator tank. The pressurized gas is delivered through an unrestricted passage during beverage dispensing such that the gas pressure forces the carbonated water from the carbonator. However, the problem exists of an occurrence of too high a pressure being exerted during dispensing operations and a resulting burst of liquid from the dispensing valve when opened. The use of complicated pressure regulator valve external of the apparatus necessitates additional equipment and is prone to malfunction.

SUMMARY OF THE INVENTION

Accordingly, an important object of the present invention is to provide improved carbonating apparatus for carbonating water for mixing with a syrup prior to being mixed and dispensed from a dispensing valve.

Yet another important object of the present invention is to provide a carbonating apparatus for carbonating water wherein the delivery of carbonated water therefrom is done in a pressure regulated manner.

Still another important object of the present invention is to provide an improved carbonating valve assembly for a carbonating apparatus.

The above objectives are accomplished according to the present invention by providing a carbonating valve head assembly wherein a water entrance valve subassembly, a pressurized gas regulator valve subassembly, and a vent valve subassembly are included. In a novel feature of the invention, the pressurized gas regulator valve subassembly includes a pressure regulator valve which permits a restricted flow of pressurized gas therethrough when the carbonating apparatus is non-dispensing and which permits delivery of an unrestricted flow of pressurized carbon dioxide during dispensing operations. During both the non-dispensing and dispensing modes, the pressure regulating valve member senses the pressure of the gas delivered to the carbonating apparatus. Should the level of pressure of the gas exceed a predetermined level, the pressure regulating valve seals off the entrance passage to the carbonating container for both the restricted and unrestricted flow of gas. Thus, in the presence of an excessive pressure of gas, the carbonating apparatus will not deliver to the dispensing and mixing valve. In other novel aspects of the invention, a water entrance valve subassembly includes a feature which permits venting of the carbon dioxide to the atmosphere instead of the main water lines should check valve failure occur. Other aspects of the invention will become apparent after a reading of the detail description of the preferred embodiment.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
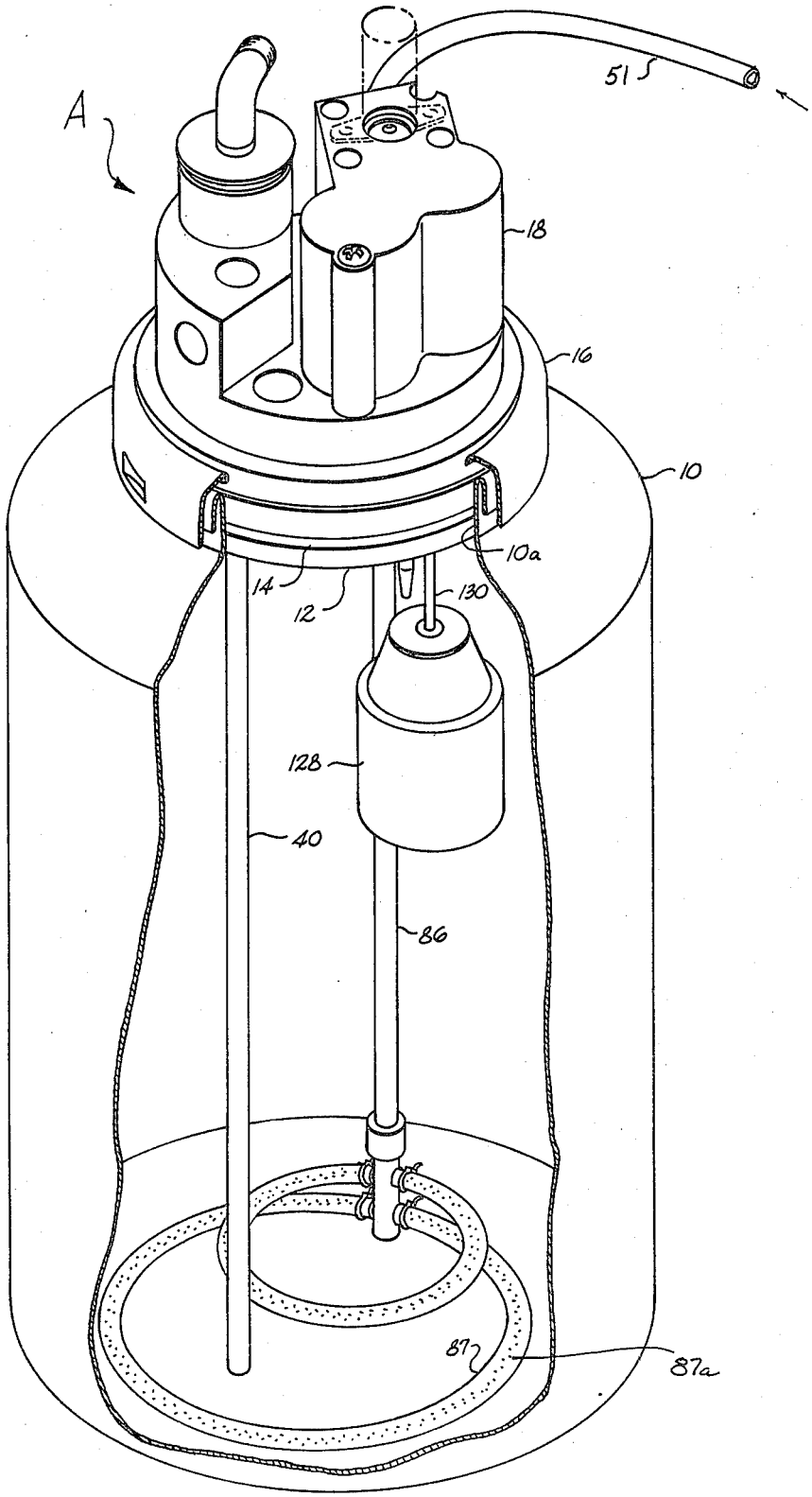
FIG. 1 is a cut-away perspective view illustrating carbonating apparatus constructed according to the present invention.
Figure 2:
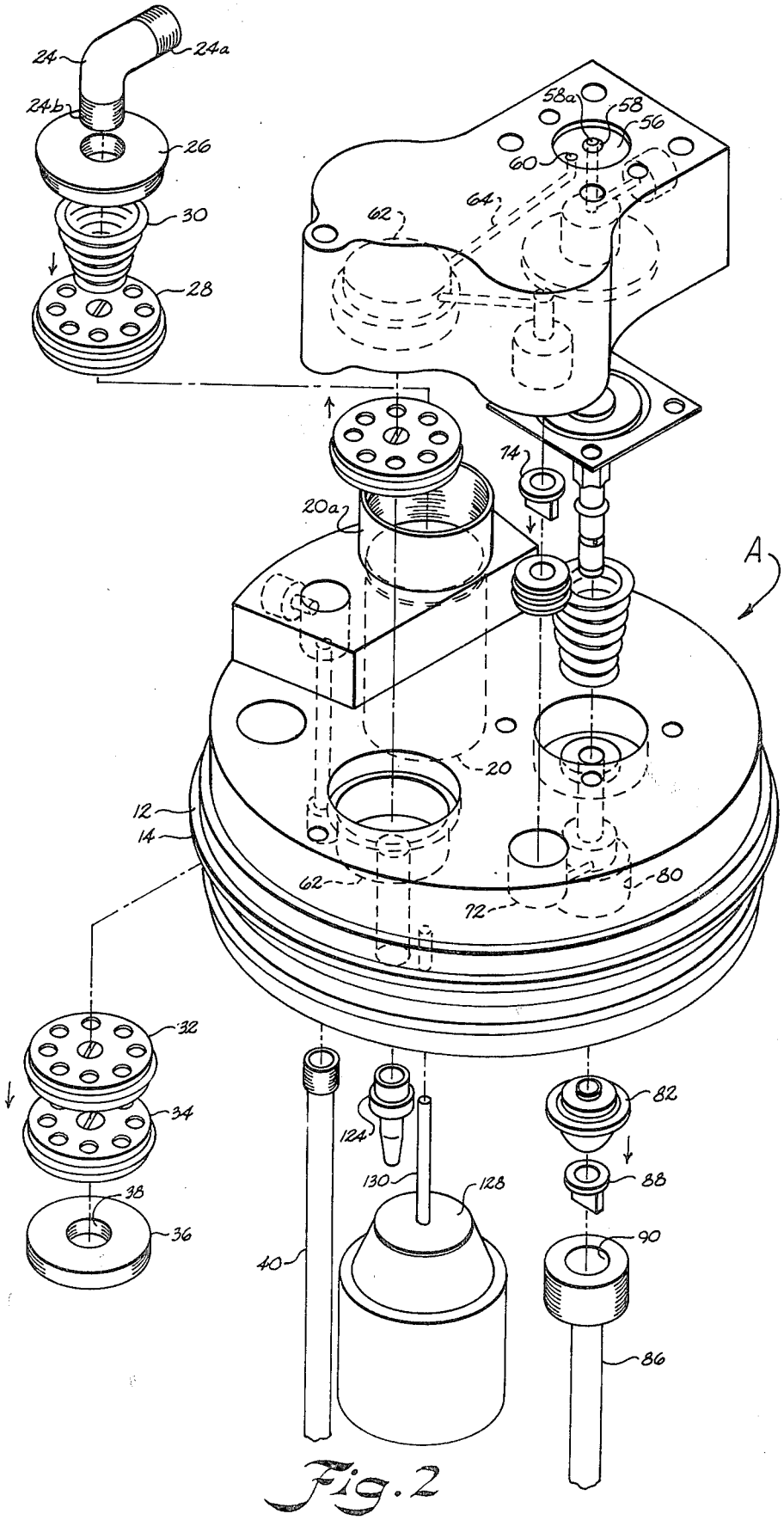
FIG. 2 is a perspective view with parts exploded illustrating a carbonating valve head assembly for carbonating apparatus constructed according to the present invention.

The drawings illustrate carbonating apparatus wherein a liquid is carbonated and delivered to a mixing valve wherein the carbonated liquid and a syrup are mixed and dispensed as a carbonated beverage.

There is a carbonator tank 10 having a neck portion 10*a* in which a carbonator valve head assembly A is seated having a valve head 12 sealed by means of an O-ring 14. A lid 16 locks on the neck 10*a* to secure the valve head assembly 12. A valve head cover 18 is carried by and affixed to the valve head 12.

Figure 3:
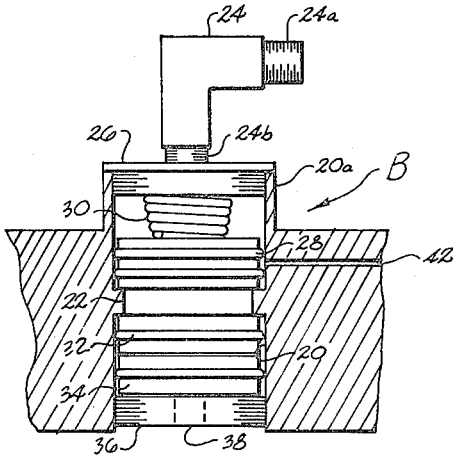
FIG. 3 is a sectional view taken along the water valve entrance subassembly according to the present invention.

The carbonator valve head assembly A includes three subassemblies. There is a water valve entrance subassembly designated generally as B as can best be seen in FIG. 3. There is a gas entrance regulator valve subassembly designated generally as C as can best be seen in FIG. 4. There is a gas vent subassembly designated generally at D as can best be seen in FIG. 5.

The water entrance subassembly B includes a passageway 20 formed in the valve head 12. An abutment collar 22 is formed in the passageway and extends radially therein. There is an elbow entrance fitting 24 having a nipple or threaded coupling portion 24*a*. The opposite leg of the elbow 24 includes a threaded fitting 24*b* which is threadably received in a threaded closure plate 26. The threaded closure plate 26 is threaded into the neck 20*a* of the passage 20. There is a check valve unit 28 carried in the passage 20 between the abutment collar 22 and the threaded closure plate 26. There is a compression spring 30 between the check valve unit 28 and closure plate 26. Below the abutment collar 22 is a second check valve unit 32 and a third check valve unit 34. The outlet end of the passage 20 includes a threaded return plate 36 having a outlet aperture 38.

Water or other suitable liquid entering the inlet nipple 24*a* passes serially through the check valve units 28, 32, and 34, into the carbonator tank 10. The check valve units check the flow of carbon dioxide in the reverse direction. Therefore, when the carbonator tank 10 is under pressure, flow of the carbon dioxide will be prevented in a reverse direction through the water valve entrance subassembly. In the event that check valve units 32 and 34 should fail, check valve unit 28 will be forced upwardly against the compression spring 30 and the pressurized carbon dioxide will be vented to the atmosphere through a vent 42 formed in the valve head 12. This is necessary in order to insure that pressurized carbon dioxide cannot enter the source of the liquid such as a main water line.

The gas entrance regulator valve subassembly C includes an entrance port 50 connected to a source (not shown) of pressurized carbon dioxide or other suitable pressurized gas by a supply line 51. Entrance port 50 includes a first passage 50*a* which communicates with a second vertical passage 52. Passage 52 communicates with a first entrance chamber 54 and with a second, control valve chamber 56 which includes a valve seat 58 and valve opening 58*a* containing therein. A port 60 in chamber 56 communicates with a third chamber 62 by means of a third passage 64. A check valve unit 66 is carried in the chamber 62 which allows flow in the direction of the arrow.

There is an outlet port 68 in the chamber 62 which communicates by means of a fourth passage 70 with a fourth chamber 72 in which a check valve 74 is carried by means of a removable housing 76 having O-ring 76*a* which seals the chamber. Check valve 74 allows flow in the direction of the arrow. Chamber 72 includes an outlet port 72*a* which communicates by way of a fifth passage 78 with a fifth, gas dispensing chamber 80. There is a dispensing valve fitting 82 in the chamber 80 which includes a valve seat 84 and passage 84*a* therethrough which delivers pressurized gas through a dispensing pipe 86 into the bottom of the carbonator tank 10. There is a check valve 88 carried in a seat 90 of the dispensing pipe 86 which allows flow in the direction of the arrow. Conventional surgical tubing is utilized at 87 for sparging and distributing the carbon dioxide evenly about the container. It has been found that the small holes 87*a* made in the surgical tubing by a small guage needle allows the gas to flow into the container in a very efficient and effective manner. The gas pressure opens the needle holes for delivery. The opening and closing of the holes prevents clogging by dirt particles.

A safety pressure regulator valve means E is included in the gas entrance valve regulator subassembly C which includes a diaphragm operated valve member 96. There is a flexible diaphragm 98 carried between the valve head 12 and the valve head cover 18. There is a valve passage 100 formed in the valve member 96. The valve passage 100 has a restricted outlet port 102 formed in a recessed annular groove 102*a* formed in valve member 96. There is a bias spring 104 against which the valve member 96 acts. Spring 104 is carried in an enlarged chamber 106. The end of valve member 96 includes a rubber tip 108 which seals against the valve seal 84 of the valve fitting 82 when the valve member 96 is urged downwardly to close off passage 84*a*.

There is a conventional solenoid operated control valve 110 carried in a valve housing 112 for opening and closing valve seat 58. In practice and with normal operating pressure, the pressurized gas coming through the entrance port 50 passes through the passage 50*a* and 52 into the chamber 56 of the valve housing 112 with valve 110 open. The pressurized gas then travels through passage 64, check valve 74, passage 78, valve passage 84*a* and check valve 88 into the carbonator tank 10. The pressurized gas thus forces the carbonated water in the carbonator tank 10 through an outlet pipe 116, passage 118, outlet port 120 formed in the valve head 112 to a conventional mixing and dispensing valve (not shown) wherein the carbonated water and syrup are mixed prior to dispensing. Port 120 is connected to the dispensing valve by suitable tubing. The outlet pipe 116, not seen in the carbonator tank of FIG. 1, is nevertheless extending into the carbonator tank adjacent the bottom thereof.

The gas vent subassembly D includes an entrance port fitting 124 having a passage 126 formed therein. A float member 128 is slidably carried on a post 130 affixed to the valve head 12. The float includes a rubber seal 132 which closes the open entrance end 124*a* of the valve fitting 124 when the carbonator tank is filled with water and the float is forced against the valve seat. Valve fitting 124 enters into a passage 134 formed in the valve head 12 which terminates in chamber 62. Check valve unit 66 carried therein permits flow in the direction of the arrow. When the carbonator tank 10 is being filled with water, the float 128 is off of the valve seat 124*a* and gas is permitted to vent through the fitting 124, passage 134, check valve unit 66, through passage 64 into the valve housing 112. In this position, solenoid valve 110 is seated on the valve seat 58*a* but is off of the seat of a vent 136 such that the gas is vented to the atomosphere. This enables filling of the carbonator tank. Once the carbonator tank is filled the vent valve 124 is cut off by float 128.

Figure 4:
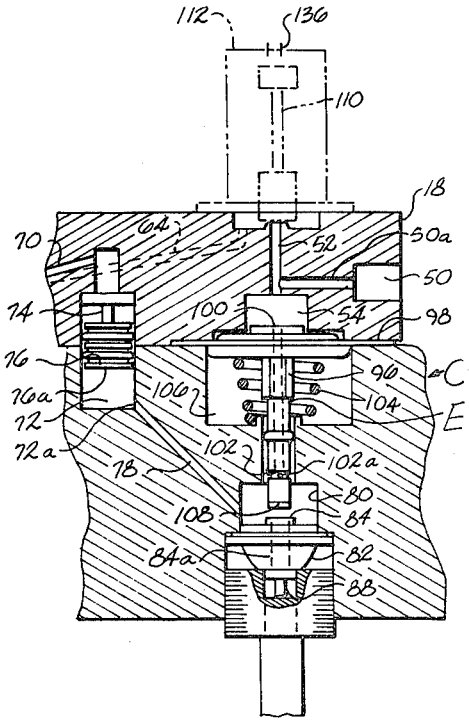
FIG. 4 is a sectional view taken along the pressurized gas regulator valve subassembly according to the invention.
Figure 5:
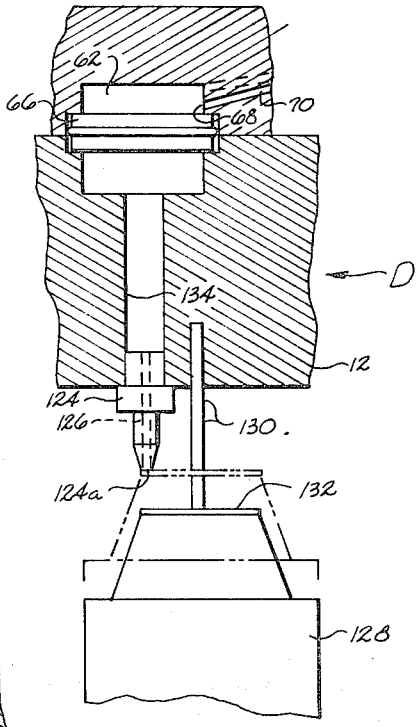
FIG. 5 is a section view of a vent valve subassembly according to the invention.
Figure 6:
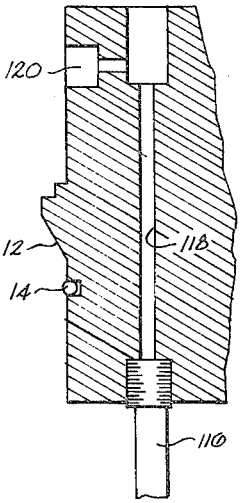
FIG. 6 is a sectional view of a carbonated water outlet according to the present invention.

The solenoid valve 110 is operated in a conventional manner in response to the dispensing valve (not shown) being open. The dotted line position in FIG. 4 is that of when the dispensing valve is closed such that the vent is open at 136. When the dispensing valve is open, solenoid control valve 110 is operated, open seat 58 in a conventional manner.

The safety pressure regulator valve means E serves to protect the carbonator container from being overpressurized. In operation, with the solenoid valve 110 closed as shown in FIG. 4, pressurized gas will enter the port 50 and passage 50*a* into the chamber 54. The gas will then pass through the valve passage 100 and out of the restricted port 102 into the carbonator container to maintain the water therein carbonated at all times so as to be ready for dispensing upon opening of the dispensing valve. However, in the case that the pressure of the gas should exceed a predetermined pressure such as 60 psi, the diaphragm 98 and valve member 96 will be forced downwardly against the spring 104 such that the valve end 108 of the valve member seals against the seat 84 of the valve fitting 82. Thus, the flow of pressurized gas will not be permitted to be delivered in the normal course of flow to the carbonator tank even should the dispensing valve be open and the solenoid valve 110 be lifted off of seat 58. The gas entrance regulator valve subassembly C provides an automatic means for preventing overpressurization of the carbonator tank 10. This prevents accidental delivery of carbonated water from the tank which has dangerously high levels.

Check valve units 28, 32, 34, and 66 disclosed herein may have any suitable construction such as shown in U.S. Pat. No. 4,132,241. Check valves 74 and 88 are preferably simplified check valves such as a conventional flexible rubber leaf type with a slit therein.

While a preferred embodiment of the invention has been described using specific terms, such description is for illustrative purposes only, and it is to be understood that changes and variations may be made without departing from the spirit or scope of the following claims.

What is claimed is:

1. Carbonating apparatus of the type wherein carbonated water is delivered from a carbonator tank to a dispensing valve wherein the carbonated water is mixed with a syrup and dispensed therefrom as a carbonated beverage, said carbonating apparatus comprising:

a carbonator valve assembly adapted for being sealably carried by said carbonator tank;

a water entrance valve subassembly included in said carbonator valve assembly for delivering water into the interior of said carbonator tank;

a gas entrance regulator valve subassembly included in said carbonator valve assembly for deliverying pressurized gas to the interior of said carbonator tank from a source of pressurized gas;

a gas vent valve subassembly included in said carbonator valve assembly for venting said pressurized gas from said interior of said carbonator tank during filling of said tank with water;

a first passage formed in said carbonator valve assembly for connection with a source of pressurized gas;

a first chamber formed in said carbonator valve assembly connected to said first passage;

said gas pressure regulator valve subassembly including a pressure regulator valve means which includes a gas pressure responsive valve member carried in said first chamber;

a second passage formed in said carbonator valve assembly connected to said first chamber;

a control valve chamber connected to said second passage having a control valve carried therein;

a third passage formed in said carbonator valve assembly connected to said second passage via said control valve chamber which may be opened and closed by said control valve for controlling flow between said second and third passages;

a gas dispensing chamber formed in said carbonator valve assembly in fluid flow communication with said third passage;

a valve seat fitting carried in said gas dispensing chamber including a check valve for permitting flow of said pressurized gas into said carbonator tank while checking flow in a reverse direction;

said gas pressure responsive valve member including a valve passage formed in a body of said valve member communicating with said first chamber, a restricted outlet port formed in said valve member terminating said valve passage communicating with said gas dispensing chamber;

said restricted outlet port of said valve passage delivering a restricted flow of pressurized gas to said carbonator tank to maintain a pressure head on said carbonator tank when said control valve member is closed;

said pressurized gas being delivered in a relatively unrestricted path via said control valve chamber and said gas dispensing chamber into said carbonator tank when said control valve is opened so as to force said carbonated liquid from said container for admixing with said syrup; and said pressure regulator valve member including a diaphragm element carried across said first chamber and a spring against which said valve member moves carried on a remote side of said diaphragm element opposite said first chamber, said regulator valve member moving in response to a predetermined excess pressure to close off said dispensing chamber valve seat to prevent both said restricted an unrestricted gas flows.

2. The apparatus of claim 1 wherein said restricted outlet port of said regulator valve member is formed in a recessed annular groove formed in a body of said safety valve member to prevent accumulation of contamination matter in said restricted outlet port.

3. The apparatus of claim 1 wherein said gas vent subassembly includes a third chamber formed in said carbonator valve assembly in said third passage, a check valve unit carried in said third chamber, said third passage communicating with said third chamber on a first side of said check valve unit, the remote side of said check valve unit being in fluid communication with said carbonator tank interior, and said check valve permitting flow of vent gases through said third chamber and third passage to said second control valve chamber.

4. The apparatus of claim 1 including a fourth chamber formed in said valve head assembly between said third chamber and said gas dispensing chamber, a check valve member being carried in said third chamber permitting flow only to said gas dispensing chamber.

5. The apparatus of claim 1 wherein said water entrance valve subassembly includes a passage bore formed in said valve head assembly, an annular abutment collar formed in said passage bore extending radially into said bore, a first liquid check valve slidably carried in said passage bore between an entrance port and said annular collar, and a biasing spring carried between said entrance port and said first liquid check valve unit urging said check valve unit against said annular collar; a second water check valve unit and a third water check valve unit carried below said annular abutment collar in series with said entrance port and said first water check valve unit, and a water outlet in fluid communication with said third check valve unit for delivering water into said carbonated tank interior; a vent passage formed in said carbonator valve assembly between said annular abutment collar and said entrance port, said first water check valve unit being urged against said spring in a direction opposite to the flow of said water in response to the failure of said second and third water check valve units such that pressurized gas is vented through said vent passage.

6. The apparatus of claim 1 wherein said pressure regulator valve member includes a valve body stem depending downwardly from said diaphragm element in which said valve passage is formed, a bore communicating between said first chamber and said gas dispensing chamber, said valve stem being slidably carried in said bore extending into said gas dispensing chamber.

7. The apparatus of claim 6 including a valve tip terminating said valve stem, said valve tip closing off said valve seat of said dispensing valve fitting upon exertion of said excess pressure on said diaphragm element.

8. A pressure regulator valve assembly for delivering a restricted flow of fluid and cutting off a restricted and unrestricted flow of the gas in response to an excess pressure comprising:

a first passage adapted for connection to a source of pressurized gas;

a first chamber communicating with said first passage;

a regulator valve member carried in said first chamber;

a second passage connected to said source of pressurized gas via said first chamber;

a control valve chamber communicating with said second passage;

a third passage connected to said control valve chamber;

a control valve carried in said control valve chamber selectively opening and closing communication between said second and third passages;

a gas dispensing chamber communicating with said third passage including a valve seat opening for communicating with an interior of a carbonating vessel;

said pressure regulator valve member having a restricted passage communicating between said first chamber and said gas dispensing chamber;

said second passage, said control valve chamber, said third passage, and said dispensing gas chamber establishing a relatively unrestricted gas flow path;

said pressure regulator valve being actuated in response to an excess of gas pressure to close off said valve seat of said gas delivery chamber and thus both said restricted and unrestricted gas flows into said carbonator vessel.

9. The apparatus of claim 1 or 8 including gas sparging means for sparging and distributing said gas into said container.

10. The apparatus of claim 9 wherein said gas sparging means includes a length of surgical tubing connected to said valve seal of said gas delivery chamber having minute needle holes formed therein which open and close in response to gas pressure to allow said gas to enter said container.

* * * * *